US005660279A

United States Patent [19]

Apps et al.

[11] Patent Number: 5,660,279

[45] Date of Patent: Aug. 26, 1997

[54] STACKABLE LOW DEPTH BOTTLE CASE

[75] Inventors: William P. Apps, Alpharetta; Gerald R. Koefelda, Atlanta, both of Ga.

[73] Assignee: Rehrig Pacific Company, Inc.

[21] Appl. No.: 384,331

[22] Filed: Feb. 1, 1995

Related U.S. Application Data

[63] Continuation-in-part of Ser. No. 919,376, Jul. 29, 1992, Pat. No. 5,529,176.

[51] Int. Cl.[6] ..... B65D 21/00

[52] U.S. Cl. ..... 206/503; 206/505; 206/509

[58] Field of Search ..... 220/503, 504, 220/509, 511, 512, 516, 517, 518, 519, 139, 201, 203, 427, 505; 206/503, 505, 509

[56] References Cited

U.S. PATENT DOCUMENTS

| | | |
|---|---|---|
| D. 147,981 | 11/1947 | Lehman . |
| D. 195,702 | 7/1963 | Russo . |
| D. 201,257 | 6/1965 | Vidal . |
| D. 255,097 | 5/1980 | Carroll et al. . |
| D. 266,709 | 10/1982 | Box . |
| D. 284,841 | 7/1986 | Rowland et al. . |
| D. 285,851 | 9/1986 | Rehrig . |
| D. 289,938 | 5/1987 | Warwick . |
| D. 291,178 | 8/1987 | Toms . |
| D. 304,123 | 10/1989 | Warwick . |
| D. 313,493 | 1/1991 | Apps et al. . |
| D. 317,670 | 6/1991 | Apps . |
| D. 318,552 | 7/1991 | Apps . |
| D. 319,129 | 8/1991 | Apps et al. . |
| D. 320,298 | 9/1991 | Apps et al. . |
| D. 325,279 | 4/1992 | Apps . |
| D. 326,749 | 6/1992 | Apps et al. . |
| D. 327,357 | 6/1992 | Rehrig . |
| D. 327,972 | 7/1992 | Apps et al. . |
| D. 329,931 | 9/1992 | Apps . |
| D. 329,932 | 9/1992 | Apps . |

(List continued on next page.)

FOREIGN PATENT DOCUMENTS

| | | |
|---|---|---|
| 247904 | 8/1962 | Australia . |
| 680197 | 10/1966 | Belgium . |
| 693216 | 7/1967 | Belgium . |
| 965056 | 3/1975 | Canada . |
| 1109433 | 9/1981 | Canada . |

(List continued on next page.)

OTHER PUBLICATIONS

Exhibits A & B: Two photos of an embodiment of U.S. Pat. No. 4,773,544 to Warwick.

Exhibits D–F: Three photos of a bottle neck resting type crate with projections above the other side walls.

(List continued on next page.)

*Primary Examiner*—Steven M. Pollard

*Attorney, Agent, or Firm*—Banner & Witcoff, Ltd.

[57] ABSTRACT

A stackable case for retaining and transporting bottles including outer side walls forming an outer shell having a longitudinal axis and a horizontal axis, a case bottom disposed substantially within the outer shell, and a plurality of supports for supporting the outer surfaces of the bottles and which, in combination with the outer shell and the case bottom, define a plurality of bottle retaining pockets. A first receiving structure extends above the height of a top surface of one of the side walls and has a first longitudinal recess and a first transverse recess for cross-stacking with an upper identical case by receiving a side wall of the upper identical case when the lower cross-stacking case is empty. A second receiving structure having a second longitudinal recess along the longitudinal axis of the case and a second transverse recess along an axis parallel to the transverse axis of the case is also provided in a preferred embodiment. Ribs corresponding to the location of the receiving structures are disposed on the bottom of the case such that the size of the openings in the bottom structure is reduced. The case also includes a handle structure which allows the bottle case to be manipulated with either a palm up or palm down orientation of the hand.

30 Claims, 12 Drawing Sheets

U.S. PATENT DOCUMENTS

| | | |
|---|---|---|
| D. 360,758 | 8/1995 | Umiker . |
| 1,112,943 | 10/1914 | Stone . |
| 2,064,518 | 12/1936 | Brogden . |
| 2,411,673 | 11/1946 | Vechey, Jr. . |
| 2,530,481 | 11/1950 | Rawn, Jr. . |
| 2,535,493 | 12/1950 | Gerber . |
| 2,588,805 | 3/1952 | Cross . |
| 2,626,079 | 1/1953 | Keller . |
| 2,743,030 | 4/1956 | Read, Jr. . |
| 2,760,676 | 8/1956 | Knieriem et al. . |
| 2,840,256 | 6/1958 | Cobb, Jr. . |
| 2,928,530 | 3/1960 | Sauey . |
| 2,935,222 | 5/1960 | O'Connell . |
| 2,970,715 | 2/1961 | Kappel et al. . |
| 2,974,819 | 3/1961 | Melville . |
| 2,979,222 | 4/1961 | Levine . |
| 3,009,579 | 11/1961 | Entlinger, Jr. . |
| 3,055,542 | 9/1962 | Russo . |
| 3,092,284 | 6/1963 | Stout . |
| 3,148,797 | 9/1964 | Cloyd . |
| 3,151,762 | 10/1964 | Vidal . |
| 3,155,268 | 11/1964 | Fogerty et al. . |
| 3,184,148 | 5/1965 | Poupitch . |
| 3,247,996 | 4/1966 | Garcia . |
| 3,283,947 | 11/1966 | Cornelius . |
| 3,297,190 | 1/1967 | Cloyd . |
| 3,326,410 | 6/1967 | Asenbauer . |
| 3,332,574 | 7/1967 | Earp . |
| 3,333,727 | 8/1967 | Belcher et al. . |
| 3,333,729 | 8/1967 | Rabb . |
| 3,334,767 | 8/1967 | Cornelius et al. . |
| 3,349,943 | 10/1967 | Box . |
| 3,376,998 | 4/1968 | Cornelius . |
| 3,379,339 | 4/1968 | Asenbauer . |
| 3,384,261 | 5/1968 | Austin . |
| 3,390,801 | 7/1968 | Adomat . |
| 3,391,814 | 7/1968 | Box . |
| 3,391,815 | 7/1968 | Box . |
| 3,392,869 | 7/1968 | Needt . |
| 3,416,694 | 12/1968 | Bebb . |
| 3,447,715 | 6/1969 | Beney . |
| 3,517,852 | 6/1970 | Schoeller . |
| 3,547,309 | 12/1970 | Pusey et al. . |
| 3,638,824 | 2/1972 | Sekiguchi et al. . |
| 3,651,976 | 3/1972 | Chadbourne . |
| 3,701,449 | 10/1972 | Schoeller . |
| 3,734,341 | 5/1973 | Levenhagen . |
| 3,759,416 | 9/1973 | Constantine . |
| 3,812,996 | 5/1974 | Bunnell . |
| 3,865,239 | 2/1975 | Herolzer et al. . |
| 3,949,876 | 4/1976 | Bridges et al. . |
| 4,027,796 | 6/1977 | Martin . |
| 4,037,722 | 7/1977 | Bremer . |
| 4,040,517 | 8/1977 | Torokvei . |
| 4,071,162 | 1/1978 | Steinlein et al. . |
| 4,095,720 | 6/1978 | Delbrouck et al. . |
| 4,101,049 | 7/1978 | Wallace et al. . |
| 4,105,117 | 8/1978 | Atkin et al. . |
| 4,120,444 | 10/1978 | Gray . |
| 4,161,259 | 7/1979 | Palafox . |
| 4,162,738 | 7/1979 | Wright . |
| 4,202,448 | 5/1980 | Jaeger et al. . |
| 4,204,596 | 5/1980 | Davis . |
| 4,319,685 | 3/1982 | David . |
| 4,344,530 | 8/1982 | deLarosiere . |
| 4,349,121 | 9/1982 | Lafferty . |
| 4,410,099 | 10/1983 | deLarosiere . |
| 4,416,373 | 11/1983 | deLarosiere . |
| 4,520,941 | 6/1985 | Hagan et al. . |
| 4,548,320 | 10/1985 | Box . |
| 4,619,371 | 10/1986 | Rehrig . |
| 4,671,411 | 6/1987 | Rehrig et al. . |
| 4,700,836 | 10/1987 | Hammett . |
| 4,700,837 | 10/1987 | Hammett . |
| 4,759,451 | 7/1988 | Apps . |
| 4,773,554 | 9/1988 | Warwick . |
| 4,789,063 | 12/1988 | Hammett . |
| 4,823,955 | 4/1989 | Apps . |
| 4,848,580 | 7/1989 | Wise . |
| 4,899,874 | 2/1990 | Apps et al. . |
| 4,932,532 | 6/1990 | Apps et al. . |
| 4,978,002 | 12/1990 | Apps et al. . |
| 5,031,774 | 7/1991 | Morris et al. . |
| 5,060,819 | 10/1991 | Apps . |
| 5,071,026 | 12/1991 | Apps . |
| 5,184,748 | 2/1993 | Apps . |
| 5,335,814 | 8/1994 | Hepp . |
| 5,421,447 | 6/1995 | Hammett . |
| B1 4,344,530 | 3/1988 | deLarosiere . |

FOREIGN PATENT DOCUMENTS

| | | |
|---|---|---|
| 99827 | 2/1984 | European Pat. Off. . |
| 1285689 | 1/1962 | France . |
| 1351218 | 12/1963 | France . |
| 1518610 | 2/1968 | France . |
| 2401087 | 3/1979 | France . |
| 1207268 | 12/1965 | Germany . |
| 1486412 | 5/1969 | Germany . |
| 6505562 | 10/1966 | Netherlands . |
| 943947 | 12/1963 | United Kingdom . |
| 1032916 | 6/1966 | United Kingdom . |
| 1115343 | 5/1968 | United Kingdom . |
| 1120067 | 7/1968 | United Kingdom . |
| 1152038 | 5/1969 | United Kingdom . |
| 1312701 | 4/1973 | United Kingdom . |
| 1319726 | 6/1973 | United Kingdom . |
| 1330778 | 9/1973 | United Kingdom . |
| 2079256 | 1/1982 | United Kingdom . |
| 2135278 | 8/1984 | United Kingdom . |
| 2158044 | 11/1985 | United Kingdom . |
| WO 82/01536 | 5/1982 | WIPO . |
| WO 92/15758 | 12/1990 | WIPO . |

OTHER PUBLICATIONS

Exhibits G–J: Four photos of a bottle neck resting type crate without projections above the outer side walls.

Exhibit K: One photo of a bottle neck resting type crate with different height outer side walls.

Exhibit L: Four photos of an embodiment of Great Britain Patent Publication No. 2,158,044 & U.S. Design Patent No. D289,938.

Exhibit M: Copy of a brochure illustrating an embodiment of GB No. 2,158,044/U.S. D289,938.

Exhibit N: Copy of a brochure illustrating an embodiment of U.S. Pat. No. 4,773,554 & an embodiment of GB No. 2,158,044/U.S. D289,938.

Exhibit O: Four photos of an embodiment of U.S. Pat. No. 4,344,530 to deLarosiere.

Exhibit P: Two photos of an embodiment of U.S. Pat. No. 4,700,837 to Hammett.

Exhibit Q: Four photos of an embodiment of U.S. Pat. No. 4,344,530 for 3–liter PET bottles Exhibit R: Four photos of a modified embodiment of U.S. Pat. No. 4,700,837 for 3–liter PET bottles.

Exhibit S: Three photos of an embodiment of U.S. Pat. No. 3,392,869 to Needt.

Exhibit T: Four photos of a prior art crate of Rehrig–Pacific Company, Model No. PLBC–8–2L–HD.

Exhibit U: Four photos of a prior art crate of Rehrig–Pacific Company Model No. PLBC–6–2L–HD.

Exhibit V: Four photos of a prior art crate of Rehrig–Pacific Company, Model No. PLBC–8–2L–PET–QD.

Exhibit W & X: Brochures including a PBC–6–2L (LO) crate for 2–liter bottles.

Exhibit Y: Brochure and photo, "Interlocking bottom grid. Cross stackable".

Exhibit Z: One–page brochure disclosing a prior art 2–liter PET case having a plurality of notches on the top wall.

Exhibit AA: One–page brochure illustrating a prior art 2–liter PET case.

Exhibit 1: Two photos of a prior art case of Rehrig Pacific for 3 liter PET bottles.

Exhibit 2: Two photos of a prior art case of D.W. Plastics.

Exhibit 3: Two photos of a prior art case of ICS for 3 liter PET bottles.

Exhibit 4: Three photos of a prior art case of ICS for 2 liter PET bottles.

STACKABLE LOW DEPTH BOTTLE CASE

CROSS-REFERENCE TO RELATED APPLICATION

This application is a continuation-in-part of U.S. application Ser. No. 07/919,376, filed 29 Jul. 1992, now U.S. Pat. No. 5,529,176.

TECHNICAL FIELD

The present invention relates to low depth stackable bottle cases for use in retaining and transporting bottles. More particularly, the present invention relates to beverage bottle cases that combine low depth with high stability for stored bottles, and cross-stacking versatility for high stability when stored empty.

BACKGROUND OF THE INVENTION

Plastic bottles are widely used as containers for retailing soft drinks and other beverages. One type of plastic, polyethylene terephthalate (PET), has become particularly popular because of its transparency, light weight, and low cost. In addition to being flexible, the walls of PET bottles are strong in tension and thus can safely contain the pressure of a carbonated beverage. Moreover, conventional PET bottles can bear surprisingly high compressive loads, provided that the load is directed substantially along an axially symmetric axis of the bottle. A single PET bottle can support the weight of many bottles of the same size filled with beverage if the bottle is standing upright on a flat, horizontal surface and the weight of the other bottles is applied to the closure of the single bottle and is directed substantially vertically along the symmetric axis. However, if a compressive load is applied to a conventional PET beverage bottle along a direction other than the symmetry axis of the bottle, the bottle tends to buckle. This tendency of conventional PET bottles to give way under off-axis compressive loads is particularly pronounced for large capacity bottles, such as the two-liter bottle widely used for marketing soft drinks.

Soft drink bottles are ordinarily packaged by bottlers in cases or other containers, several bottles to the case, for shipment to retailers or for storage. Cases of bottles are customarily stacked on top of each other. In warehouses, columns of cases are frequently stacked on pallets which can be lifted and moved about by fork-lift trucks. The stacks of cases on the pallets must therefore be particularly stable in order to remain standing in the face of the jostling inherent in being moved about. A technique for interconnecting stacks of cases, called "cross-stacking," is often used to improve the stability of empty cases loaded on a warehouse pallet. Cross-stacking generally involves stacking rectangular bottle cases to build up a layered structure, with each layer having cases oriented parallel to each other and with the adjacent layers being oriented at right angles to each other. Thus, since the adjacent layers are perpendicular, each case in the cross-stacked layer rests on at least two cases in the layer below. As a result, the cases of the cross-stacked layer tend to keep the cases on which they rest from moving apart from each other. The cross-stacked layers therefore stabilize the stacked structure.

Because of the tendency of conventional PET beverage bottles to buckle under off-axis loads, attempts to stack cases of these bottles give rise to serious problems. Bottles can tilt away from vertical alignment upon stacking if conventional partitioned cases having low side walls are used to contain the bottles. Tilted bottles in the lower cases of a stack can buckle and give way, causing the stack to fall. Even absent buckling, the tendency of bottles to tilt in conventional low-sided cases causes problems. Tilting generally places an undesirably low limit on the number of tiers in a stack since the tilting of bottles in one case can cause the next higher case in the stack to tilt. This leads to instability if too many tiers are included in the stack.

Previously, these problems were dealt with by packaging beverage bottles in corrugated-paper cartons having high sides, often equal in height to the height of the bottles. Two-liter PET bottles filled with soft drinks were often packaged in enclosed corrugated paper cartons for storage and shipment. Although the high sides of these paper cartons reduce the incidence of tilting and provide additional support when the cartons are stacked, the cartons are expensive. The cost of the cartons cannot ordinarily be distributed over a number of repeated uses since corrugated-paper cartons generally are not rugged enough for reuse and therefore they are usually discarded by the retailer.

One solution to the problems of full depth corrugated-paper cartons is plastic full depth cases. In plastic full depth cases, the sides are load bearing. Full depth plastic cases also have numerous disadvantages. They are expensive to manufacture. They are also expensive to ship and to store empty in a user's warehouse as they require lots of space. Also, they totally surround the bottles, thereby preventing display of the bottles.

To overcome these problems plastic low depth cases have been used. A low depth case is one in which the side walls are lower than the height of the stored bottles, and in which the bottles support the weight of additional cases stacked on top. However, these too have drawbacks. For example, some cases, require additional structure to hold the bottles and insure complete bottle stability, even though the case depth is more than 25% of the height of the bottles.

Various plastic reusable bottle carriers are known in the art. One reusable bottle carrier is disclosed in U.S. Pat. No. 3,055,542 to Russo. The bottle carrier can be made of a plastic, and is assembled from two pieces: a handle and a carrier body having six cups for soft drink bottles. In order to stack the bottle carriers when empty, the handles must be removed. This is very inconvenient and time consuming. The '542 bottle carrier is also seriously limited regarding stacking loaded carriers. It cannot be stacked in a conventional cross-stacked structure because, as illustrated therein, the spacing between the bottles in the carriers is different in the directions parallel and perpendicular to the handle of the carrier.

Kappel U.S. Pat. No. 2,970,715 is one of the earlier embodiments of molded plastic low depth bottle carrying cases. Each bottle rests on a raised flat surface within an individual compartment. The bottom of the case is formed with recesses for receiving bottle tops when loaded cases are vertically stacked. However, Kappel does not indicate the size of the carrying case relative to the bottles being carried.

In Bunnell, U.S. Pat. No. 3,812,996, a reusable plastic bottle carrying case for beer bottles is disclosed. The case is designed with a plurality of bottle compartments having flat bottom walls. The cases are designed to be cross-stacked; the cases are dimensioned so that the center-to-center distance between adjacent bottles within a case is the same as the center-to-center distance between adjacent bottles in adjacent cases in abutting relationship. Thus, the vertical axes of the bottles in adjacent layers are co-linear. Although a plurality of loaded carrying cases is designed to be vertically stackable with the weight of upper cases supported by the bottles within lower cases, the lower surface of the bottom wall of the case is flat. Thus, there is no structure for assuring a proper alignment or centering of one case with an upper or lower case.

Garcia, U.S. Pat. No. 3,247,996 discloses a plastic bottle container for milk bottles. The container is shorter than the bottles which extend above the top surface of the container walls. In Garcia, the bottles, rather than the walls of the container, are load bearing. Indented circular potions may be formed in the bottom wall to receive bottle tops when containers are vertically stacked. Like many prior art bottle carriers, the Garcia container has sides of reduced height from those of a standard full depth case; also, it can be used with a variety of bottles. However, the case is not a low depth case and is more expensive than low depth cases. It also does not have the display capabilities of low depth cases.

A more recent attempt to solve the problem of providing reusable, low depth, cross-stackable PET bottle cases is disclosed in U.S. Pat. No. 4,344,530 to deLarosiere. The '530 patent has many of the features and problems of Garcia and discloses a plastic PET bottle case that is cross-stackable and has a very low depth as shown in the figures. This low depth is disclosed as being approximately ⅙the height of the PET bottles, or approximately 2 inches. However, in practice, this depth is insufficient because the large degree of lateral instability does not prevent bottles from tipping over. Additionally, the bottle retaining pockets are required to have a raised annular bottle seat ring which fits within the inner indentation formed in the base of many bottles to insure bottle stability. This does not permit petaloid bottles to rotate within the bottle pockets for display purposes. Additionally, it does not permit bottles without a base indentation to be adequately retained. DeLarosiere also incorporates a bottle spacing feature that co-linearly aligns bottles to facilitate cross-stacking.

U.S. Pat. Nos. 4,899,874 and 4,978,002; the contents of which are hereby incorporated by reference, disclose a low depth bottle case for two-liter bottles that is cross-stackable when empty if the upper cross-stacked cases are properly positioned. The bottom surface of the case includes openings between the ribs, however, which when stacked and loaded with bottles have been known to catch on closures of the bottles therebelow. In addition, although the flat bottom surface permits petaloid bottles and bottles without base indentations to be retained, the low height of the case sidewalls and the columns above the case sidewalls limits the range of bottle diameters which can be retained in a stable stack since a generally snug fit is required between the bottle pocket and the bottle.

SUMMARY OF THE INVENTION

These and other problems of the prior art are overcome by the stackable low depth case of the present invention. The case includes four side walls and a bottom portion. A plurality of upwardly projecting columns are disposed in the bottom portion. The columns, walls, and bottom portion define a plurality of bottle retaining pockets. The bottle retaining pockets have flat bottom surfaces to permit retention of bottles without base indentations and to permit rotation of bottles. The columns extend upwardly from the bottom portion a distance slightly greater than one third of the height of the bottles to be retained. Thus, the columns provide a stabilizing structure without obscuring the visibility of the bottles.

The lower surface of the bottom portion has a plurality of ribs and circular concave portions with central retaining openings to facilitate stacking of filled cases top to bottom. When a case is disposed on a loaded lower case, the bottle tops of the bottles in the lower case are guided toward the central retaining openings by the circular concave portions.

At least one of the columns includes recesses along the longitudinal axis and the transverse axis of the case in order to allow for greater flexibility in stacking empty cases. More importantly, however, by providing ribs corresponding to the recesses in the columns, more ribs extend down to the bottom portion. This in turn reduces the size of the openings in the bottom potion and reduces the chance for bottles closures catching therein.

Further, the present invention provides an improved handle area on at least two sidewalls to enable easier manipulation of the case and lessen the risk of wrist injuries such as carpal tunnel syndrome. The handle area allows the case to be lifted with a person's palm facing upwards, for when the case is on the ground for example and to also be moved with a person's palm facing downwards, for when the case is stacked above the person's head for example.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF THE PREFERRED EMBODIMENTS

As shown in FIGS. 1–8, the stackable low depth bottle case 10 has four side walls 12, 14, 16, 18. Side walls 12, 16 are relatively long and side walls 14, 18 (end walls) are relatively short. Case 10 is rectangular and is therefore symmetric about both center lines which bisect the bottom surface. The depth or height of side walls 12, 14, 16, 18 is relatively low compared to the height of the bottles retained therein. Preferably, case 10 is rectangular and symmetric around both central axes. The ratio of the length of long side walls 12, 16 to the length of short side walls 14, 18 is substantially equal to the ratio of the number of bottles the case holds in the lengthwise direction to the number of bottles the case holds in the widthwise direction. For example, an 8-bottle case is twice as long as it is wide and holds bottles in a 4×2 relationship.

Figure 2:
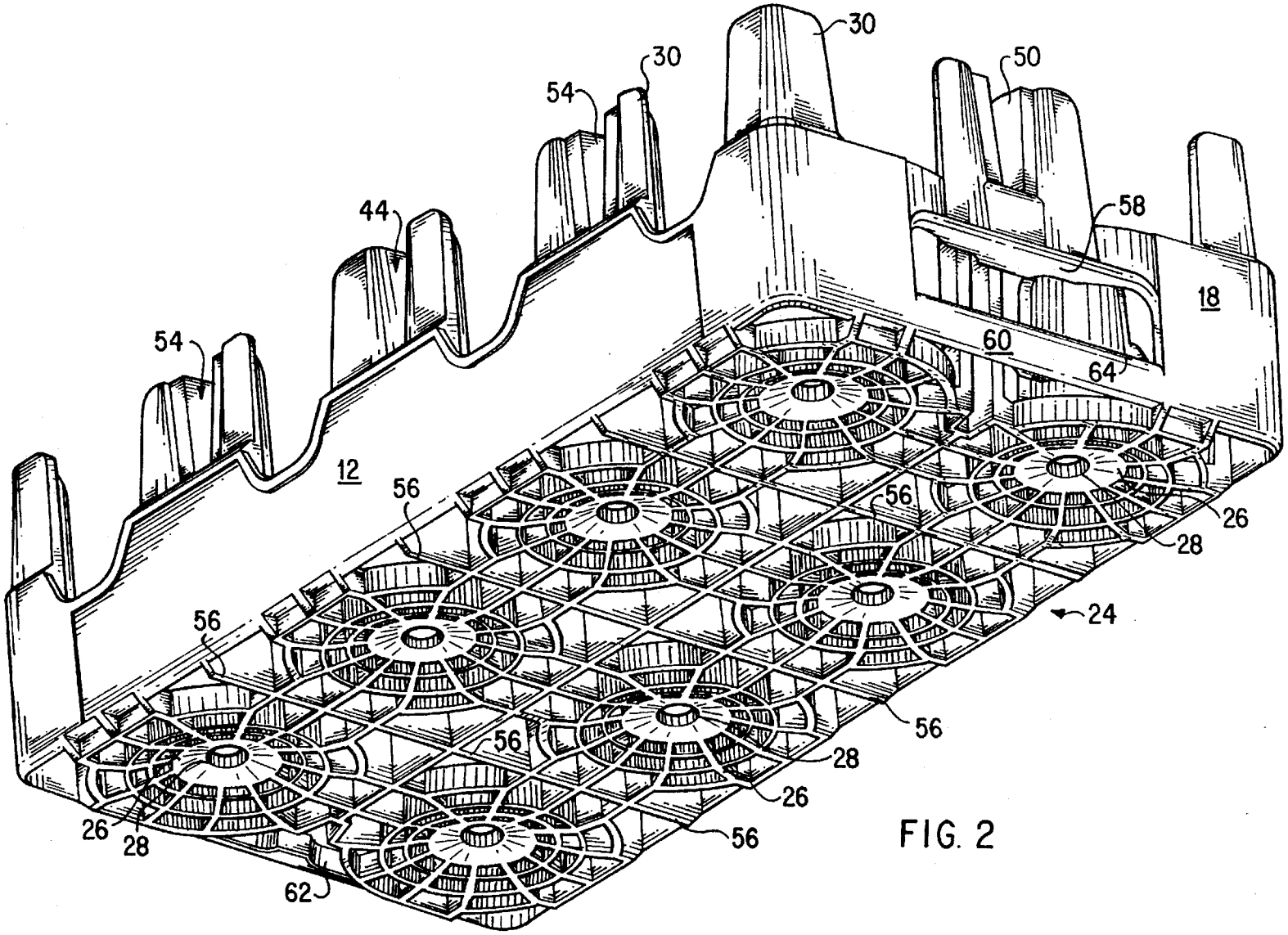
FIG. 2 is a bottom perspective thereof.
Figure 3:
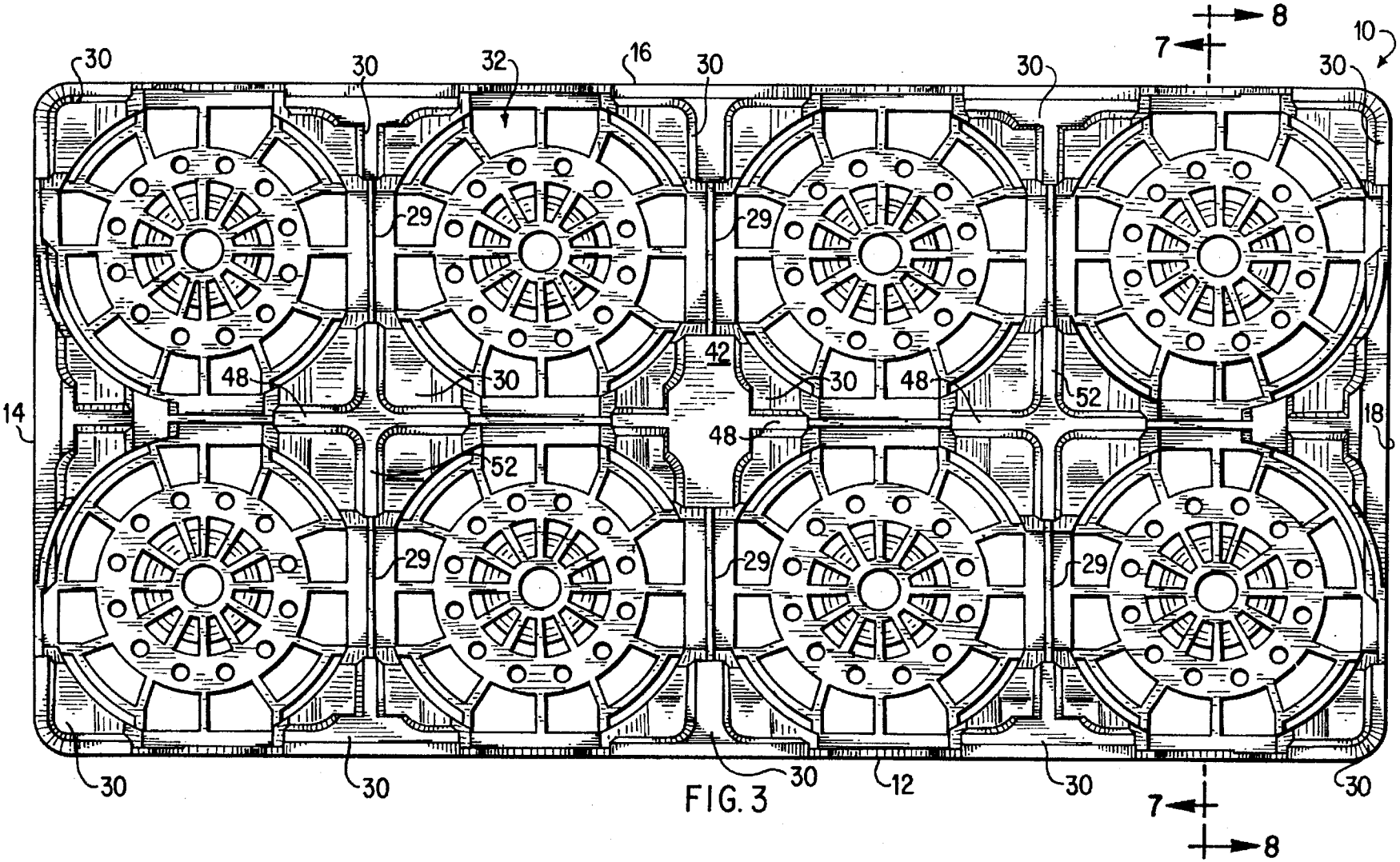
FIG. 3 is a top plan view thereof.
Figure 4:
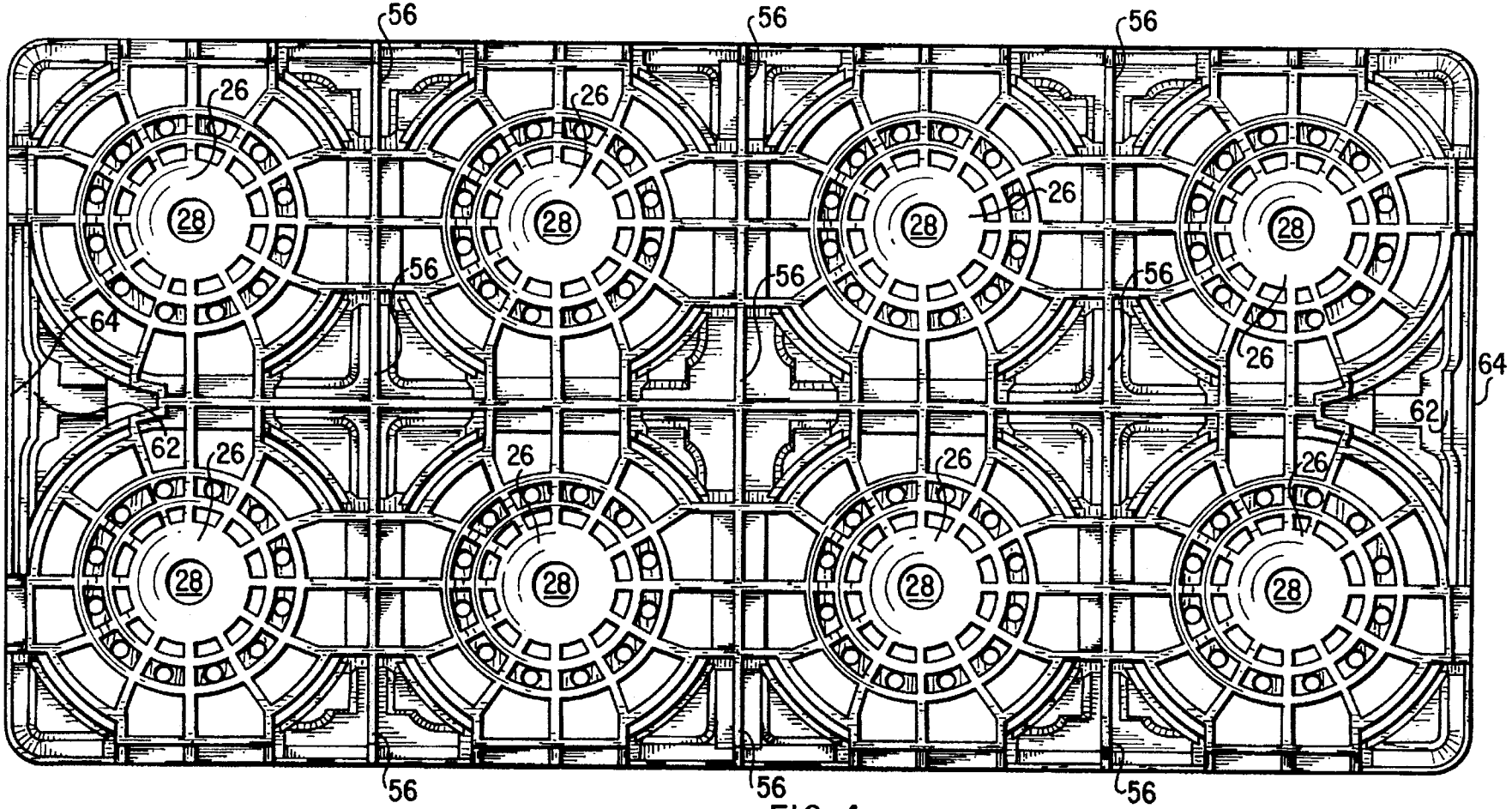
FIG. 4 is a bottom plan view thereof.
Figure 5:
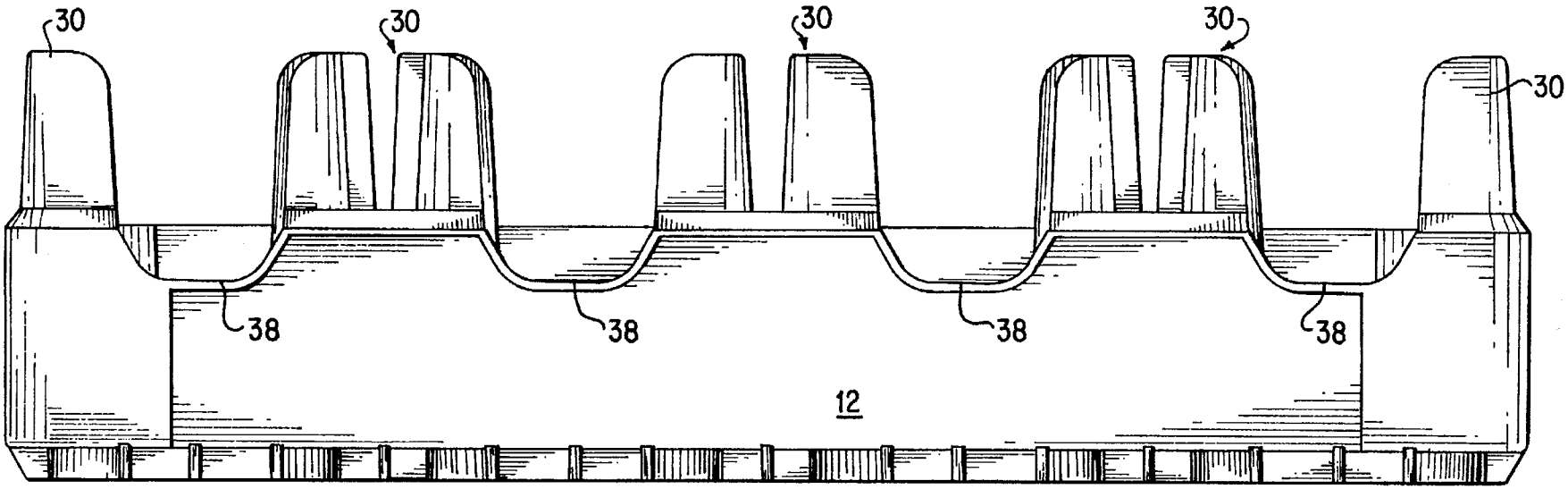
FIG. 5 is a side elevational view thereof.
Figure 6:
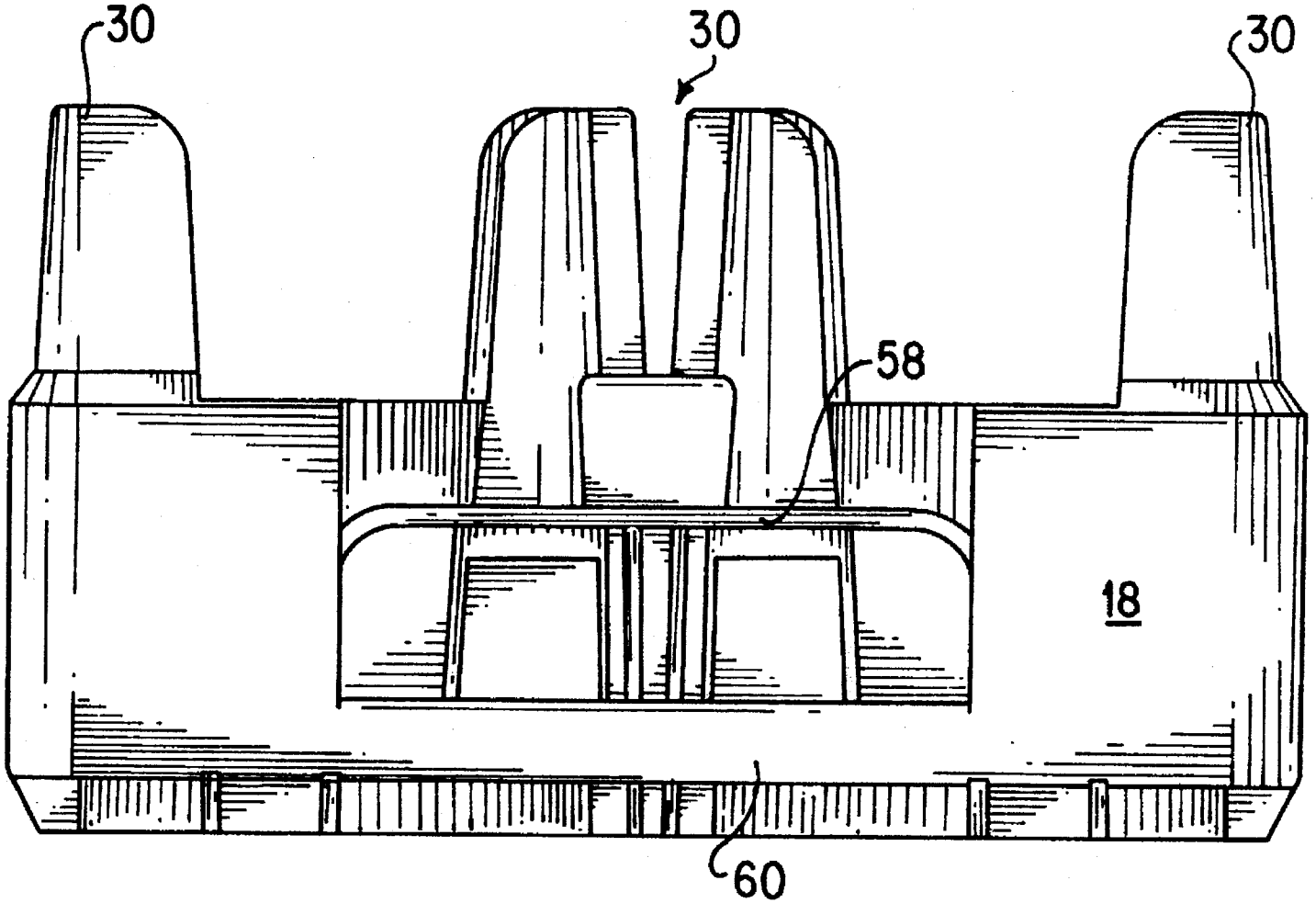
FIG. 6 is an end elevational view thereof.

As best shown in FIG. 2, case 10 also includes a bottom portion 20 attached to side walls 12, 14, 16, 18 to form the outer shell of case 10. Preferably, case 10 is made from plastic and is molded integrally as a single component. Bottom potion 20 has an upper surface 22 and a lower surface 24. Upper surface 22 is substantially flat. Lower surface 24 is formed as a plurality of circular concave portions 26 each having a central retaining opening 28 disposed therein. The number of circular concave portions corresponds to the number of bottles the case is designed to retain. The function of circular concave portions 26 and central retaining openings 28 will be described in detail below.

Case 10 is formed having a plurality of vertical walls 29 and upwardly projecting columns 30 disposed within side walls 12, 14, 16, 18. In a preferred embodiment, columns 30 do not extend to and do not contact the top surface of bottom portion 20. Vertical walls 29 do extend to the top surface of bottom portion 20. The side edges of vertical walls 29 abut columns 30 and help to secure columns 30 to bottom portion 20. Vertical walls 29 and columns 30, when combined with upper surface 22 of bottom portion 20 and sidewalls 12, 14, 16, 18, define a plurality of bottle retaining pockets 32. Columns 30 extend above bottom portion 20 a distance slightly greater than one third of the height of the bottles to be retained in case 10. For example, where cases 10 are shaped to retain 2-liter bottles, columns 30 extend upwardly approximately two inches above the sidewalls. This increases the effective height of the case while maintaining high bottle visibility and low manufacturing costs. In addition, since the taller columns increase the lateral stability of the bottle within bottle retaining pocket 32, a greater variance in the diameters of the bottles is obtained because as snug of a fit is no longer necessary, as in the prior art cases.

Columns 30 are disposed either along the walls 12, 14, 16, 18 or away from the walls, centrally within bottom portion 20. Columns 30 disposed in the corners between two adjacent walls have one curved surface 34. Columns 30 disposed on the sidewalls have two curved surfaces 34 and one flat surface 36 disposed therebetween. The two curved surfaces 34 help define two separate and adjacent bottle retaining pockets 32. Flat surface 36 is disposed between these two bottle retaining pockets. A generally bevelled edge 35 extends between the upper edge of the sidewalls and the base of the columns 30 extending therefrom. Columns 30 that are disposed centrally within bottle portion 20 are octagonally shaped. These columns 30 have four alternating curved surfaces 34 and four alternating flat surfaces 36. The four curved surfaces 34 define portions of four bottle retaining pockets 32 and the four flat surfaces 34 separate these pockets. Four curved surfaces 34 on four separate columns 30 form the four corners of a bottle retaining pocket 32. Thus, columns 30 having two curved surfaces 34 form a corner of two adjacent bottle retaining pockets 32, and columns 30 having four curved surfaces 34 form a corner of four adjacent bottle retaining pockets 32.

Figure 1:
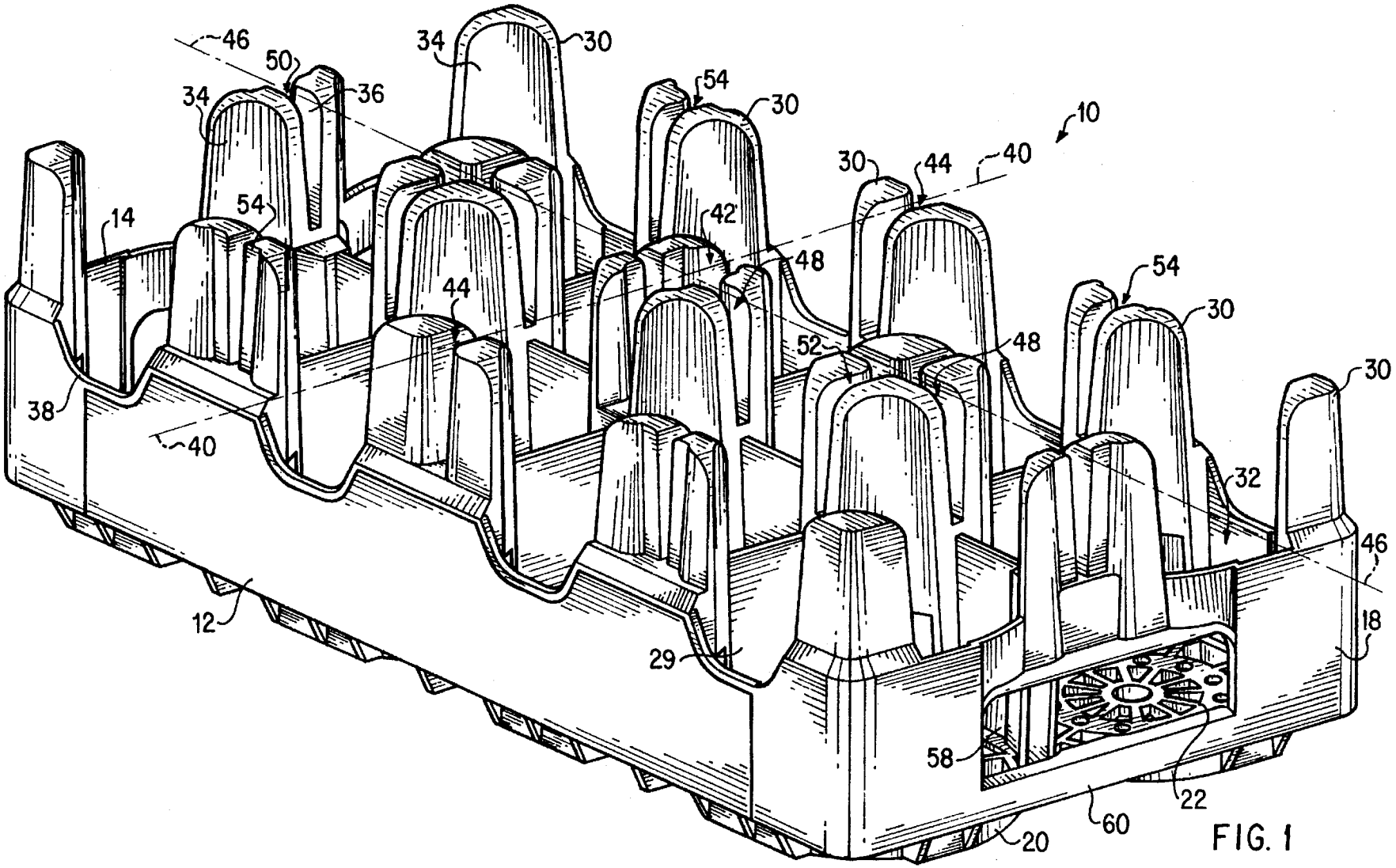
FIG. 1 is a top perspective view of a stackable low depth case according to the present invention.

As shown in FIG. 1, the columns disposed along a center line 40 of the length of the case 10 (along the transverse axis of case 10) include recesses 42, 44 which extend downwardly to a height which substantially equals a side wall height. The columns disposed along a center line 46 of the width of the case (along the longitudinal axis of case 10) also include recesses 48, 50 which extend downwardly to a height substantially equal to a side wall height. Further, the columns disposed along an axis parallel to center line 40 of the length of the case include recesses 52, 54. These recesses are for receiving a side wall of an identical upper case and provide flexibility in the stacking and cross-stacking of identical cases. For example, an upper case can be cross-stacked by rotating the case 90 degrees and placing a sidewall thereof within recesses 42, 44. Two upper cases could thus be symmetrically cross-stacked above case 10. As shown most clearly in FIGS. 1 and 9, the side columns disposed along an axis parallel to center line 40 of the length of the case further include an inset 55 between the bevel edge 35 and the base of the side column 30. This inset 55 is needed in order to accommodate the lower bar 60 of the handle when a case is cross-stacked thereabove. In addition, recess 42 in center column 30 has a width great enough to accommodate the lower bar 60 of the handle which allows a case to be stacked longitudinally offset from the case below. Thus, by providing additional recesses within the columns, flexibility in the positioning of the stacked layer can be obtained.

The upper surface 22 of bottom portion 20 within bottle retaining pockets 32 is substantially flat. This permits retention of hordes regardless of the configuration of the bottom of the bottles. Also, this allows petaloid bottles to be rotated within the bottle retaining pockets to facilitate display of the product. The low depth feature of case 10 as well as the windows or depressions 38 cut out from side walls 12, 16 further enhance display of the product labels.

Figure 7:
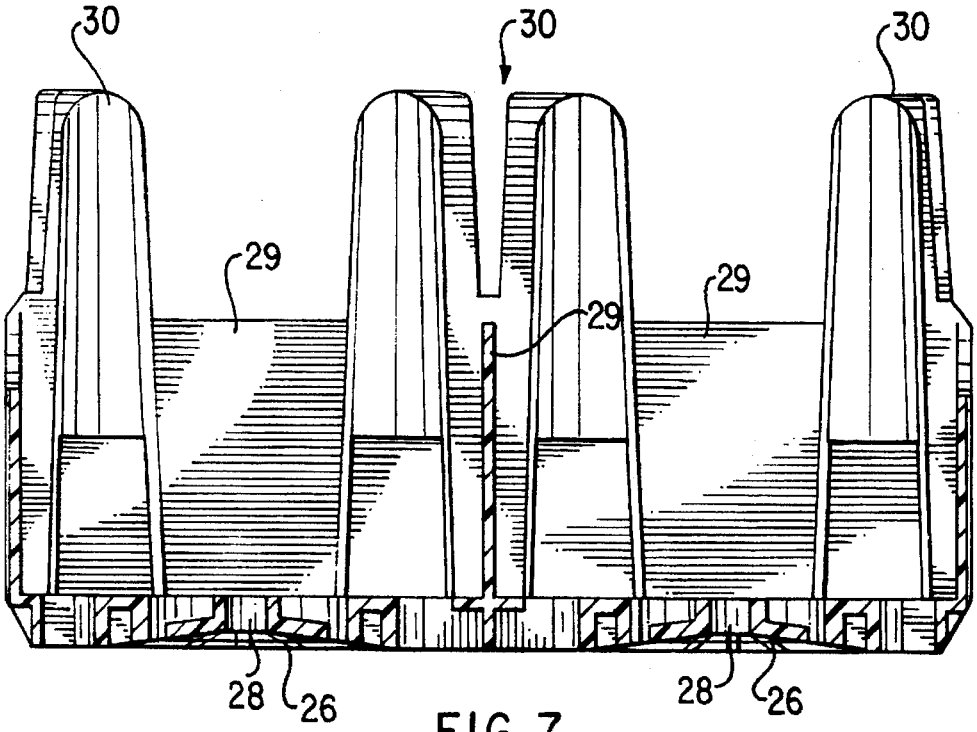
FIG. 7 is a cross-sectional view taken along the line 7—7 of FIG. 3.
Figure 8:
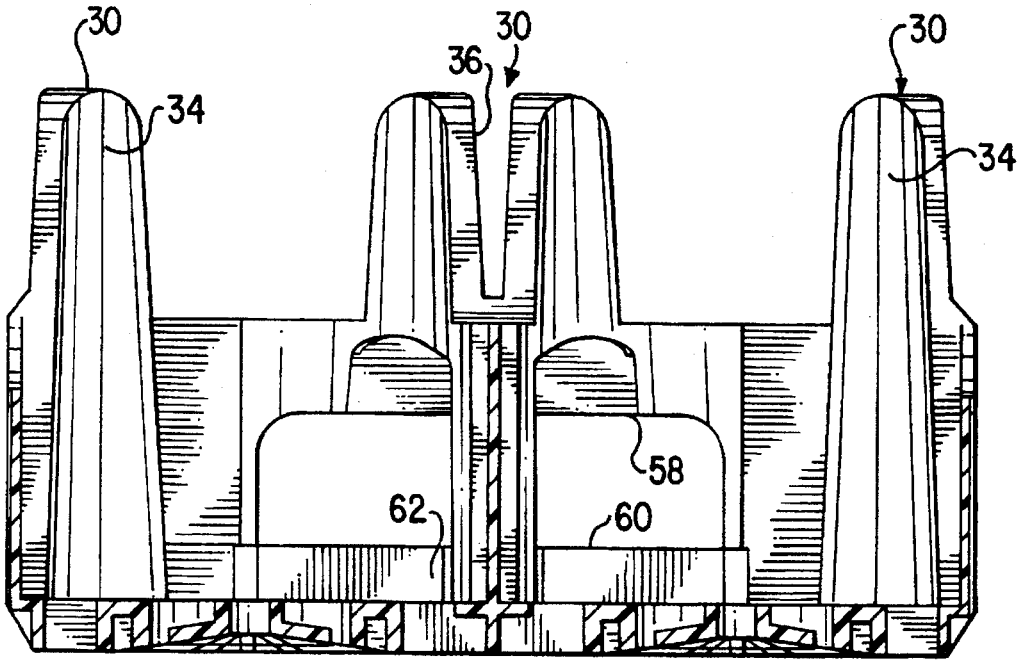
FIG. 8 is a cross-sectional view taken along the line 8—8 of FIG. 3.
Figure 9:
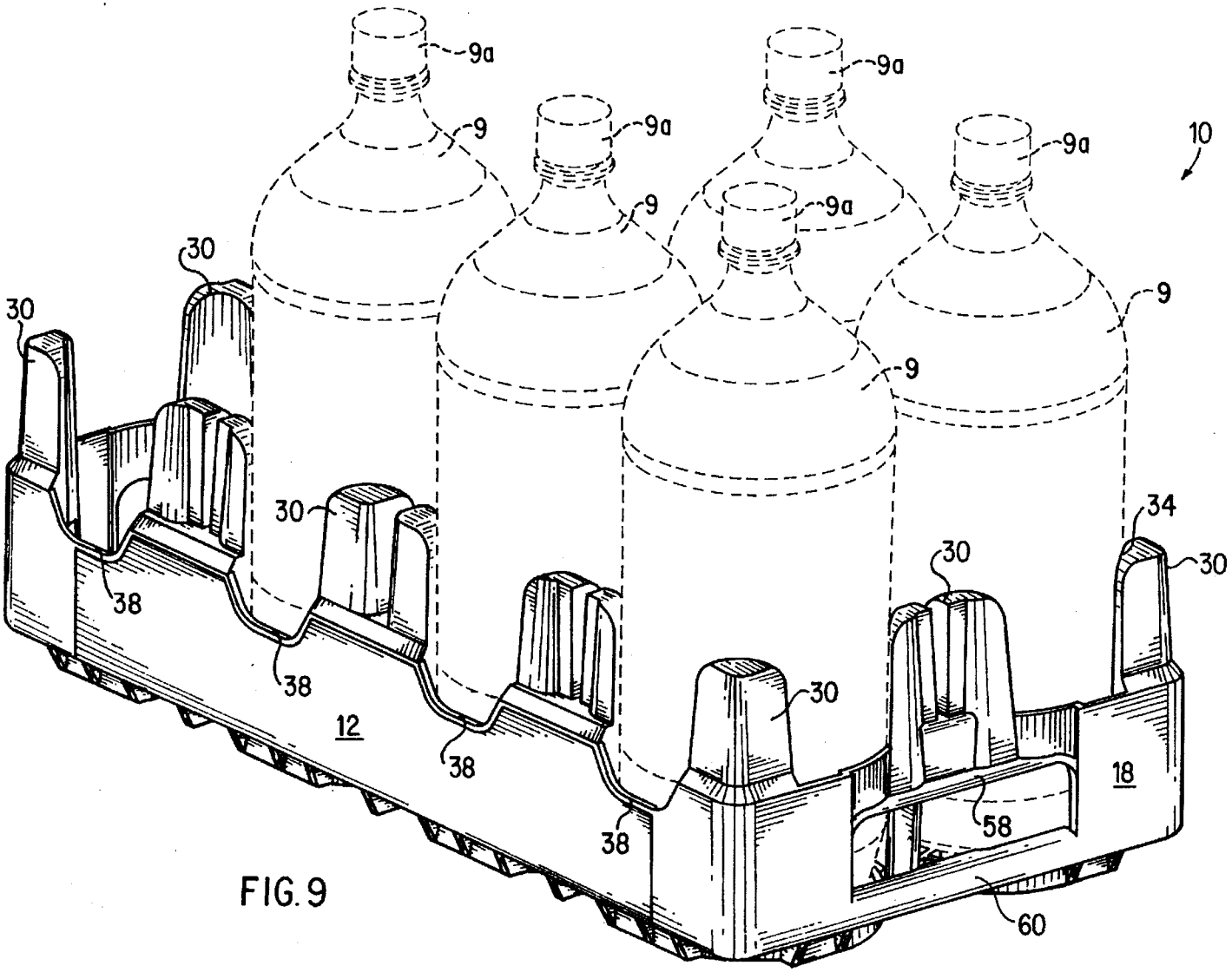
FIG. 9 is a perspective view illustrating the case partially loaded with bottles.

The circular concave portions 26 of lower surface 24, shown clearly in FIGS. 7 and 8, allow cases 10 filled with bottles to be vertically stacked for transportation, storage, and display purposes. Circular concave portions 26 are formed of ribs or projections which define the circular concave shape. These ribs also form central retaining opening 28. Referring also to FIG. 9, central retaining opening 28 is sized to receive the bottle top **9*a* of a bottle 9 which is disposed in a lower case 10. Bottle top 9*a* fits adjacent central retaining opening 28 so that central retaining opening 28 retains bottle top 9*a* in position against lower surface 24. The concave shape of circular concave portion 26 assists bottle top 9*a* to abut central retaining opening 28. When an upper case 10 is being positioned on loaded lower case 10, often bottle tops 9*a* will not precisely line up with respective central retaining openings 28. However, bottle tops 9*a* will contact circular concave portions 26 which, because of their concave shape, will guide bottle tops 9*a* into central retaining openings 28**. Additionally, the center-to-center distances between adjacent bottle retaining pockets within one case are substantially equal. Similarly, the center-to-center distances between adjacent bottle retaining pockets in adjacent cases with abutting side walls is substantially equal.

Figure 12:
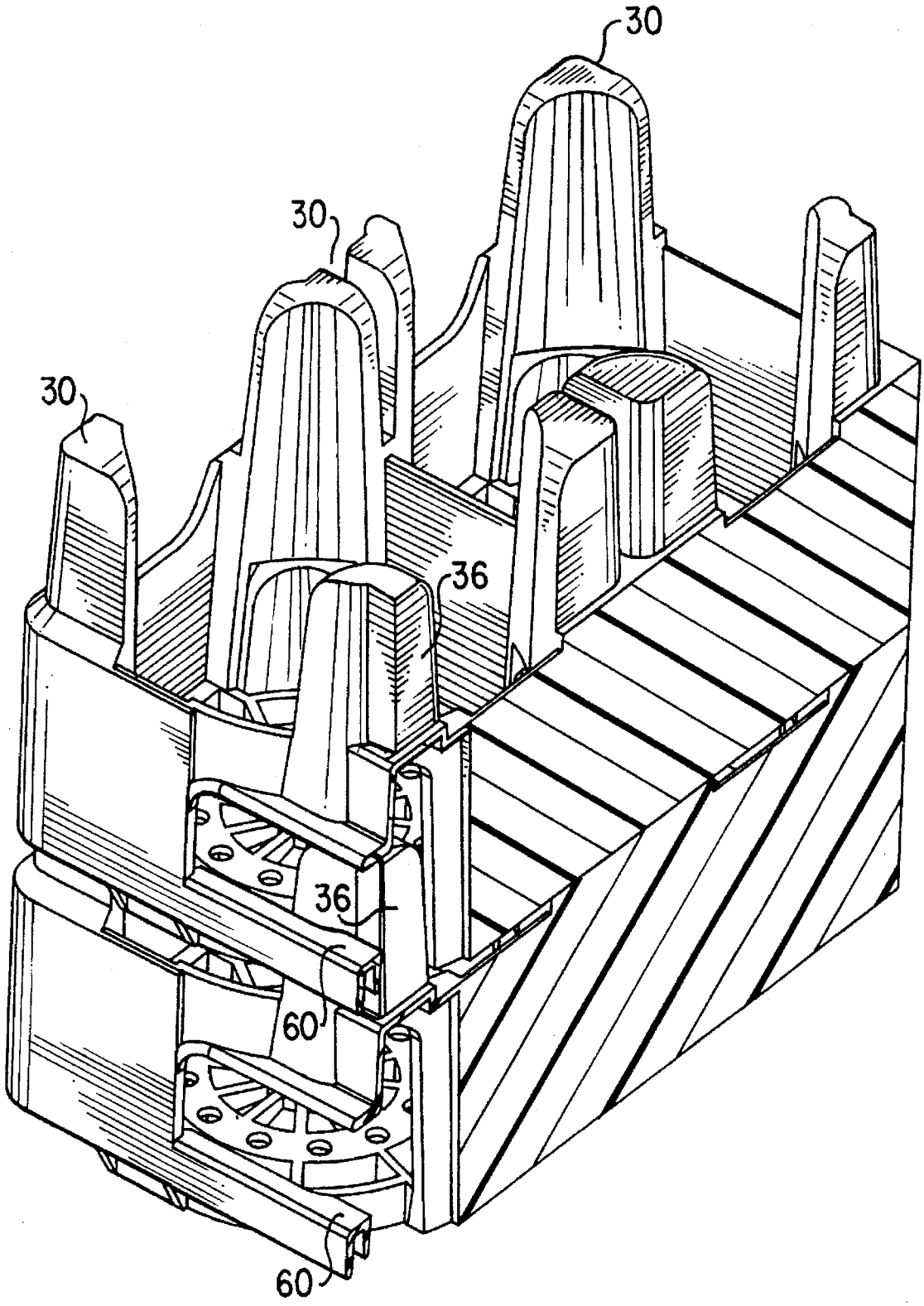
FIG. 12 is a partial cross-sectional view of the case stacked upon a lower identical case.
Figure 13:
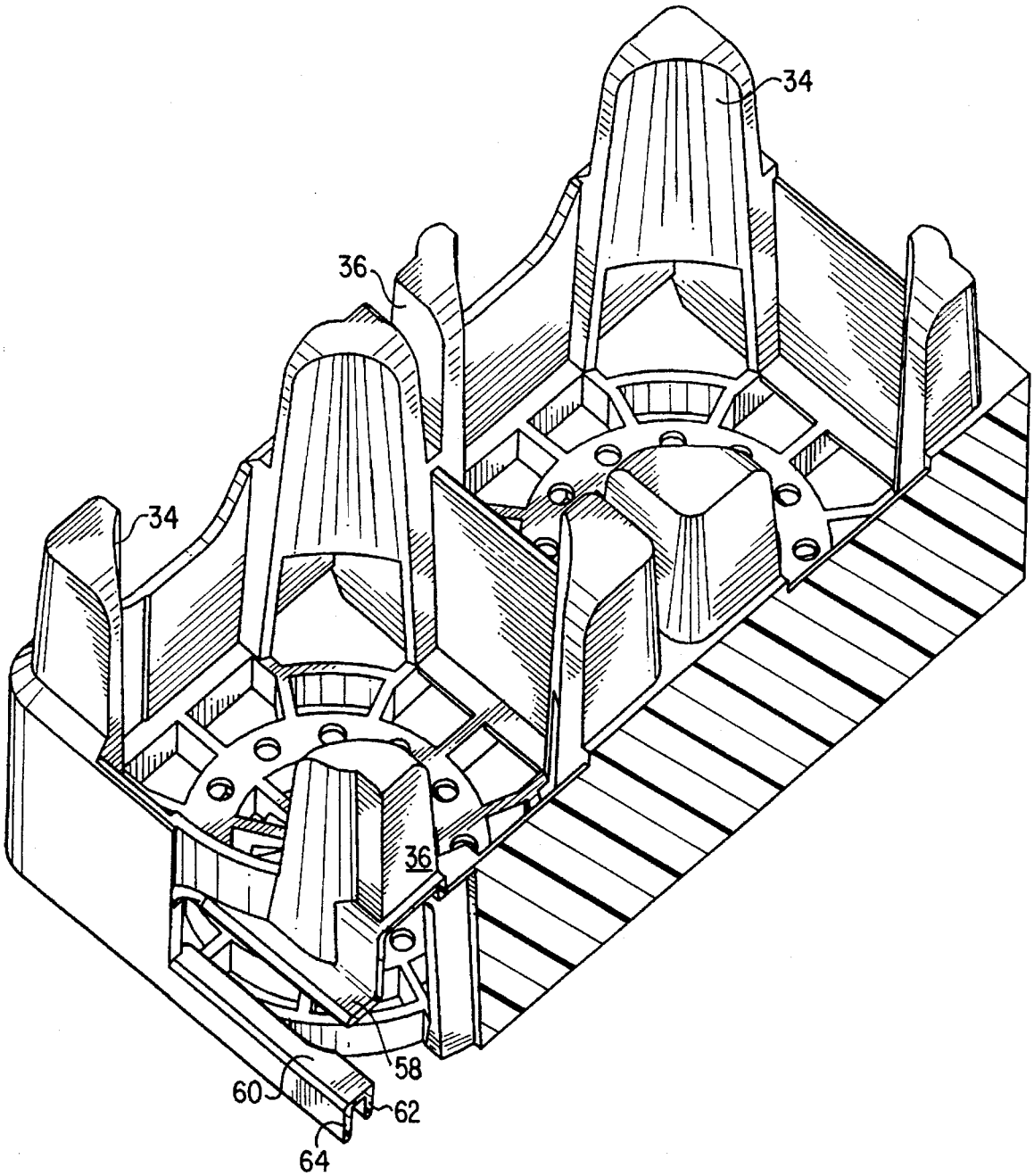
FIG. 13 is a partial sectional view of the case shown as FIG. 1.

Bottom potion 20 also includes a plurality of ribs 56 corresponding in location to recesses 42, 44, 48, 52, 54 within columns 30 and extending upwards from lower surface 24 to the bottom of the recesses. As shown in FIG. 12, the correspondence between the ribs and the column recesses still enables case 10 to be column stacked one on top of another. Further, the addition of ribs 56 to the bottom portion 20 reduces the size of the openings between adjacent circular concave portions 26. That is, the openings formed between adjacent ribs are sized generally less than 30 mm. The closures on most PET bottles in the market have an outer diameter of approximately 30 mm or 40 mm. Thus, when an upper case 10 is being positioned on a loaded lower case 10, bottle tops 9*a* are less likely to be caught within these smaller openings when the lower case is being slid across the tops of the bottles in the case therebelow. As discussed below in detail, ribs are not provided beneath recesses 50 in order to allow handle potions 58 to be gripped in a "palm up" or "palm down" manner.

Figure 10:
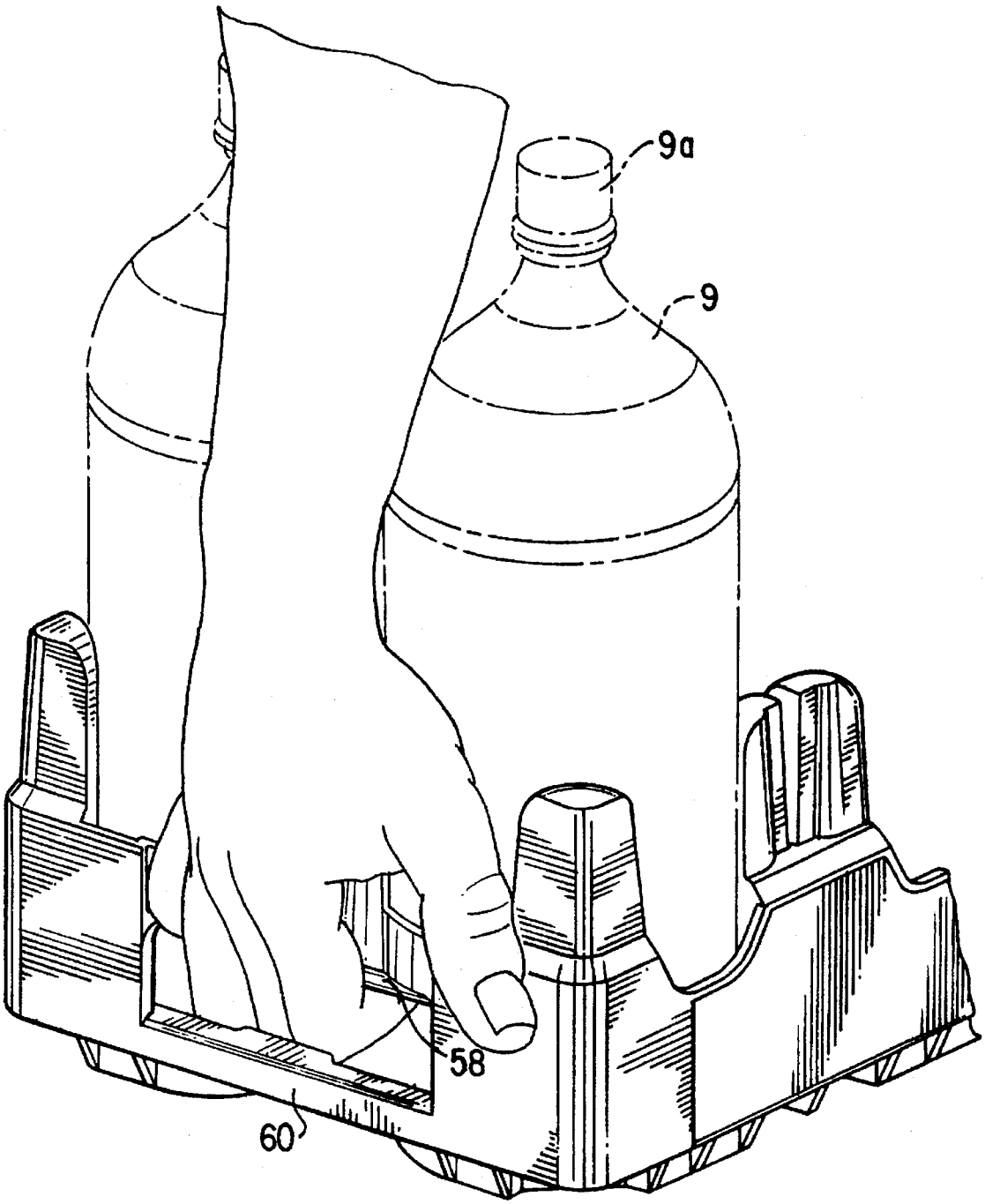
FIG. 10 illustrates the case being moved with the user's palm facing upwards.
Figure 11:
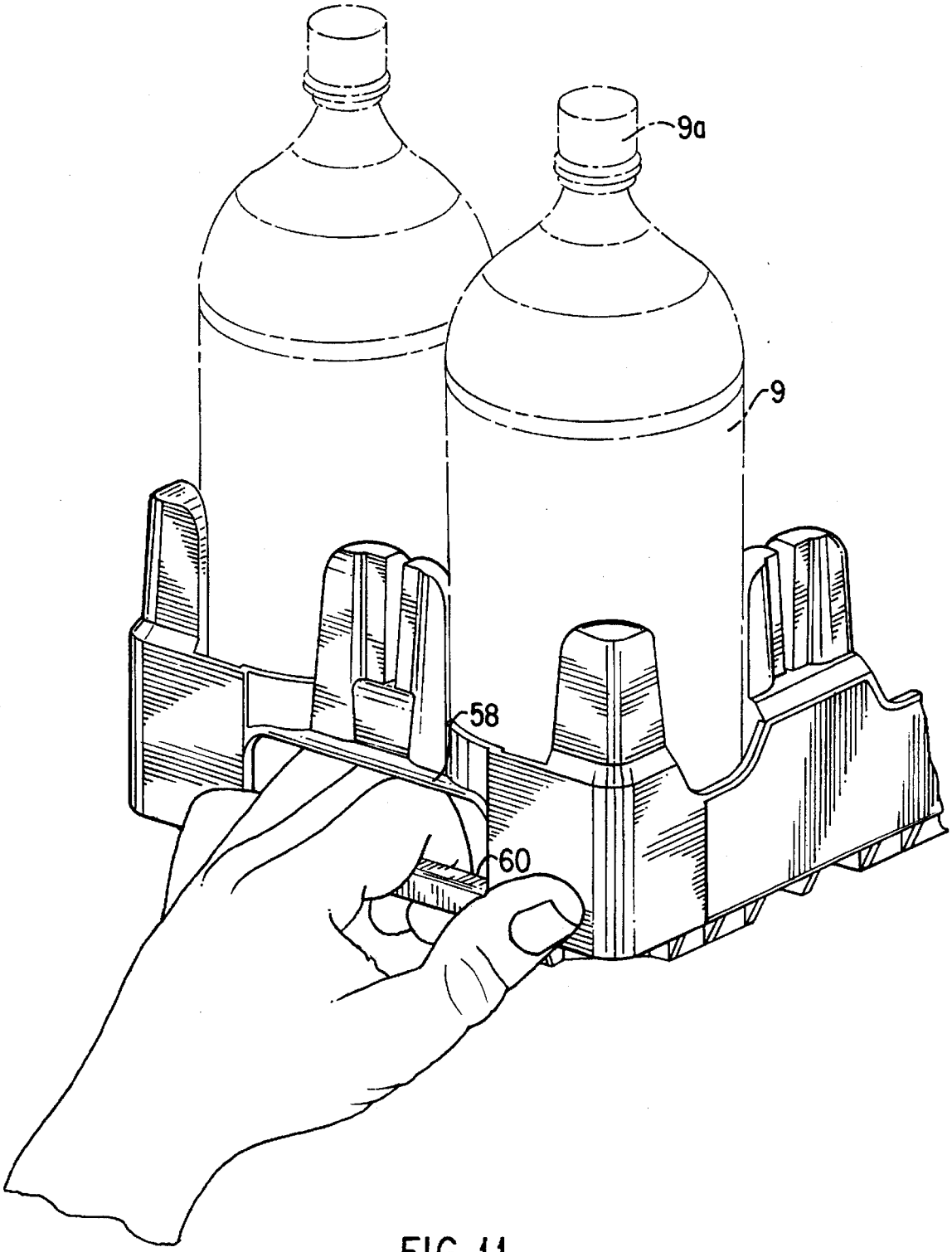
FIG. 11 illustrates the case being moved with the user's palm facing downwards.

Side walls 14, 18 are formed with handle potions 58 to facilitate carrying case 10. Handle portions 58 are formed as cutouts in the side walls, the lower bar 60 preferably having an inner wall 62 and an outer wall 64. As shown in FIG. 10, handle portions 58 can be utilized to lift case 10 in the usual manner by grasping the upper edge with the palm facing upwards and the fingers curling upwards and into the case. This manner of lifting is damaging to the wrists, however, when delivery personnel are lifting a case from above their head. Therefore, the present invention also allows handle potions 58 to be gripped with the palm facing down and the fingers curling downwards around lower bar 60 as shown in FIG. 11. As mentioned above, there are no ribs in the area immediately interior to lower bar 60 in order to assure that there is adequate space for the fingers to be inserted and curled therearound. In a further embodiment of the invention, handle portions 58 may also have finger recesses along the upper edge and/or lower edge to further aid in carrying case 10. Still further, handle potions 58 or an alternate handle configuration may be provided on sidewalls 12 and 16 in addition to sidewalls 14 and 18 such that a gripping structure is disposed on each side of the case. This orientation is advantageous for removing cross-stacked cases from a pallet because some of the cross-stacked cases will have the shorter walls 14, 18 facing the operator unloading the cases and some of the cross-stacked cases will have the longer walls 12, 16 facing the operator. Therefore, by providing a handle structure on each of the four sides, it is assured that a handle will always be readily accessible.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

We claim:

1. In a stackable low depth case for retaining and transporting bottles comprising a plurality of outer side walls forming an outer shell having a longitudinal axis and a transverse axis; a case bottom disposed substantially within said outer shell; and a plurality of spaced upwardly projecting hollow columns having a bottom opening and generally disposed within said outer shell defining, in combination with said case bottom and said outer side walls, a plurality of bottle retaining pockets, said columns extending above a top surface of one of said side walls and below a top surface of the retained bottles; said improvement comprising a first one of said columns includes a first recess along the longitudinal axis of the case and a second recess along the transverse axis of the case, said recesses corresponding in location to ribs disposed within said first one of said hollow columns such that said bottom opening of said first one of said hollow columns is reduced in size to a dimension small than a top closure of the retained bottles, whereby top closures of retained bottles in an identical subjacent case are substantially prevented from entering said bottom opening of said first one of said hollow columns.

2. A stackable case as in claim 1 wherein at least a second one of said columns includes a third recess along the longitudinal axis of the case and a fourth recess along an axis parallel to the transverse axis of the case.

3. A stackable case as in claim 1 wherein at least a third one of said columns includes a fifth recess along the longitudinal axis of the case.

4. A stackable case as in claim 1 wherein at least a forth one of said columns includes a sixth recess along the transverse axis of the case.

5. A stackable case as in claim 1 wherein at least a fifth one of said columns includes a seventh recess along an axis parallel to the transverse axis of the case.

6. A stackable case as in claim 1 wherein said case bottom includes a plurality of ribs, at least some of said ribs corresponding in location to some of said columns such that openings in said case bottom are sufficiently sized to prevent closures of the bottles in a subjacent case from entering.

7. A stackable case as in claim 6 wherein some said ribs correspond in location to said first and second of said columns.

8. A stackable case as in claim 7 wherein some of said ribs correspond in location to said forth and fifth of said columns.

9. A stackable case as in claim 1 wherein said case bottom includes an upper surface which is substantially flat across the bottle retaining pockets and a lower surface having means for resting said case bottom on closures of bottles on which said case is stacked and for guiding each closure coaxially with a centerline of one of said bottle retaining pockets.

10. A stackable case as in claim 1 wherein said case bottom includes a bevel edge for sliding said case on a lower identical case.

11. A stackable case as in claim 1 wherein said columns extend above an upper surface of said sidewalls approximately two inches.

12. A stackable case as in claim 1 wherein at least one of said outer side walls includes a window depending from a top surface thereof such that labels on the bottles are visible.

13. A stackable case as in claim 1 wherein at least two of said outer side walls include a handle structure, said handle structure permitting grasping an upper edge thereof and pulling said case with the palm of a user facing upwards.

14. A stackable case as in claim 13 wherein said handle structure further permits grasping a lower bar thereof and pulling said case with the palm of the user facing downwards.

15. A stackable case as in claim 14 wherein said second recess in said first one of said columns accommodates said lower bar of said handle structure in order to permit offset longitudinal stacking of an upper case.

16. A stackable case as in claim 14 wherein said bottom portion includes an opening corresponding in location to said lower bar sufficiently sized to permit the insertion of fingers therearound for grasping of said lower bar.

17. In a cross-stacking case for retaining and transporting bottles comprising outer side walls forming an outer shell having a longitudinal axis and a horizontal axis; a case bottom disposed substantially within said outer shell; a plurality of support means for supporting outer surfaces of bottles and generally disposed within said outer shell, said bottle support means defining in combination with said outer shell and said case bottom a plurality of bottle retaining pockets; said improvement comprising:

first receiving means, generally disposed within said outer shell, extending above the height of a top surface of one of said side walls and having at least a first horizontal recess, for receiving a side wall of an upper identical case when said lower cross-stacking case is empty;

at least two of said outer side walls including a handle structure permitting grasping an upper edge thereof and pulling said case with the palm of the user facing upwards and permitting grasping a lower bar thereof and pulling said case with the palm of the user facing downwards; and at least one of said support means being inset from an upper edge of said side wall in order to accommodate said handle structure when an upper identical case is cross-stacked on top of said case.

18. A cross-stacking case as in claim 17 further including a second receiving means, generally disposed within said outer shell, extending above the height of a top surface of one of said side walls and having a second longitudinal recess along the longitudinal axis of the case and a second horizontal recess along an axis parallel to the horizontal axis of the case.

19. A cross-stacking case as in claim 18 further including a third receiving means having a third longitudinal recess along the longitudinal axis of the case.

20. A cross-stacking case as in claim 19 further including a fourth receiving means having a fourth horizontal recess along the horizontal axis of the case.

21. A cross-stacking case as in claim 20 further including a fifth receiving means having a fifth horizontal recess along an axis parallel to the horizontal axis of the case.

22. A cross-stacking case as in claim 21 wherein each of said plurality of bottle support means defines a column and each said receiving means is associated with one of said columns.

23. A cross-stacking case as in claim 17 wherein said case bottom includes a plurality of ribs, at least some of said ribs corresponding in location to said bottle support means such that closures of the bottles are prevented from entering openings in said case bottom corresponding to said bottle support means locations.

24. A cross-stacking case as in claim 23 wherein some said ribs correspond in location to said first and second receiving means.

25. A cross-stacking case as in claim 24 wherein some of said ribs correspond in location to said fourth and fifty receiving means.

26. A cross-stacking case as in claim 21 wherein said fifth horizontal recess of said fifth receiving means is inset from an upper edge of said side wall in order to accommodate a handle structure of the upper identical case cross-stacked thereabove.

27. A low depth case for retaining and transporting bottles comprising:

four outer side walls forming a rectangular outer shell having the ratio of the length to the width of said outer shell being substantially equal to the number of bottles said case holds in the lengthwise direction to the number of bottles said case holds in the widthwise direction and having a center line of the length of the case extending through the center of the longer pair of side walls of the case and a center line of the width of the case extending through the center of the shorter pair of side walls of the case;

a case bottom disposed substantially within said outer shell;

a plurality of support means for supporting outer surfaces of bottles generally disposed within said outer shell, said bottle support means defining in combination with said outer shell and said case bottom bottle retaining pockets with at least one bottle support means associated with each pocket, adjacent said bottles pockets disposed about the centerline of the length of the case being spaced a greater distance apart than adjacent said bottle pockets disposed about the centerline of the width of the case such that said bottle retaining pockets form two identical quadrants on each side of the center line of the length of the case;

wherein a first of said plurality of bottle support means is disposed about the center line of the width of the case and includes a portion extending above the height of a top surface of a first of said side walls, said portion above the height of said first side wall including a recess which extends along the center line of the width of the case and a recess which extends along the center line of the length of the case.

28. A case as in claim 27 wherein said first bottle support means is also disposed about the center line of the length of the case; and wherein a second and third of said plurality of bottle support means are disposed about the center line of the width of the case and include a portion extending above the height of a top surface of a first of said side walls, each said portion above the height of said first side wall including a recess which extends along the center line of the width of the case and a recess which extends parallel to the center line of the length of the case.

29. A case as in claim 27 wherein a fifth and sixth of said plurality of bottle support means are disposed about the center line of the width of the case, include a portion extending above the height of the top surface of said first side wall, and include a recess within said portion with each of said recesses extending along the center line of the length of the case.

30. A case as in claim 27 wherein at least one of said plurality of bottle support means is disposed about the center line of the width of the case, include a portion extending above the height of the top surface of said first side wall, and include a recess within said portion with each of said recesses extending parallel to the center line of the length of the case.

* * * * *